US011421460B2

(12) United States Patent
Mitchell et al.

(10) Patent No.: US 11,421,460 B2
(45) Date of Patent: Aug. 23, 2022

(54) PIVOT HINGE BRACKET ASSEMBLY

(71) Applicant: Kason Industries, Inc., Newnan, GA (US)

(72) Inventors: Brett Mitchell, Newnan, GA (US); Brian Grewe, Mableton, GA (US)

( * ) Notice: Subject to any disclaimer, the term of this patent is extended or adjusted under 35 U.S.C. 154(b) by 20 days.

(21) Appl. No.: 16/944,340

(22) Filed: Jul. 31, 2020

(65) Prior Publication Data

US 2022/0034135 A1 Feb. 3, 2022

(51) Int. Cl.

| | |
|---|---|
| ***E05D 11/06*** | (2006.01) |
| ***E05D 3/06*** | (2006.01) |
| ***F25D 23/02*** | (2006.01) |
| *E05F 1/12* | (2006.01) |

(52) U.S. Cl.

CPC ..... *E05D 11/06* (2013.01); *E05D 3/06* (2013.01); *F25D 23/028* (2013.01); *E05F 1/12* (2013.01); *E05Y 2201/224* (2013.01); *E05Y 2800/674* (2013.01); *E05Y 2900/31* (2013.01); *F25D 2323/024* (2013.01)

(58) Field of Classification Search

CPC ..... E05D 11/06; E05D 7/081; E05Y 2900/31; F25D 2323/024

See application file for complete search history.

(56) References Cited

U.S. PATENT DOCUMENTS

| | | | | |
|---|---|---|---|---|
| 1,131,667 A | | 3/1915 | Bommer | |
| 2,604,653 A | | 7/1952 | Anderson et al. | |
| 2,840,848 A | | 7/1958 | Hickey | |
| 3,063,089 A | | 11/1962 | Greenman | |
| 3,254,452 A | * | 6/1966 | Costantini | E05F 1/123 49/386 |
| 3,263,365 A | | 8/1966 | Eckel | |
| 3,292,204 A | | 12/1966 | Tansey | |
| 3,299,573 A | * | 1/1967 | Gustafson | E05D 7/081 49/388 |
| 3,510,986 A | * | 5/1970 | Berkowitz | E05D 7/081 49/386 |
| 3,518,716 A | | 7/1970 | Larson | |
| 3,733,650 A | | 5/1973 | Douglas | |
| 4,215,449 A | * | 8/1980 | Loikitz | E05F 1/063 16/303 |
| 4,631,777 A | | 12/1986 | Takimoto | |
| 4,951,351 A | | 8/1990 | Eckel | |
| 5,138,743 A | | 8/1992 | Hoffman | |
| 5,682,644 A | | 11/1997 | Bohacik et al. | |

(Continued)

*Primary Examiner* — Victor D Batson
*Assistant Examiner* — Matthew J Sullivan
(74) *Attorney, Agent, or Firm* — Baker Donelson Bearman Caldwell & Berkowitz, PC

(57) ABSTRACT

A pivot hinge bracket assembly for use with a pivot hinge for a reach-in type cool room refrigerator includes two mirror imaged main bracket portions and a pivot plate removably coupled to one of the main bracket portions. The main bracket portion includes an edge mounting flange extending to a rear mounting flange mounted to the cool room refrigerator door jamb. The edge mounting flange has a modified square mounting hole and pivot pin plate screw mounting holes. The rear mounting flange has two door screw mounting holes. The pivot plate includes a pivot plate mounting flange and a pivot pin. The pivot hinge bracket assembly also includes an optional removably coupled door stop.

7 Claims, 4 Drawing Sheets

(56) References Cited

U.S. PATENT DOCUMENTS 5,970,819 A 10/1999 Katoh
6,065,187 A 5/2000 Mischenko
6,374,458 B1 4/2002 Finkelstein
6,845,545 B2 * 1/2005 Han ..... E05F 1/1269 16/277
6,862,779 B1 3/2005 Lu et al.
6,920,668 B2 7/2005 Hayashi
6,990,772 B2 1/2006 Eckel et al.
6,999,772 B2 2/2006 Song et al.
7,111,361 B2 9/2006 Li et al.
7,111,363 B2 * 9/2006 Lee ..... E05D 11/1078 16/295
7,401,382 B2 7/2008 Luo
7,480,961 B2 1/2009 Yang
7,509,709 B2 3/2009 Chung
7,526,894 B2 5/2009 Falato et al.
7,926,146 B2 4/2011 Duan et al.
7,945,996 B2 5/2011 Gunderson
8,056,186 B2 11/2011 Zhang et al.
8,381,357 B2 2/2013 Zinn
8,388,077 B2 * 3/2013 Park ..... F25D 23/028 312/405
8,444,238 B2 * 5/2013 Choi ..... F25D 23/028 312/405
8,579,394 B2 * 11/2013 Lee ..... E05F 5/00 312/405
8,621,714 B2 1/2014 Duan et al.
8,635,357 B2 1/2014 Ebersviller
8,683,655 B2 4/2014 Hong
8,701,248 B2 4/2014 Dries
9,175,900 B2 * 11/2015 Borise ..... F25D 23/021
9,222,293 B2 12/2015 Jenkinson
9,291,385 B2 * 3/2016 Hwang ..... F25D 23/00
9,568,238 B2 * 2/2017 Kim ..... E05F 1/063
9,739,523 B1 * 8/2017 Augsburger ..... F25D 23/028
9,863,691 B2 * 1/2018 Kikuchi ..... E05D 3/022
9,976,328 B2 * 5/2018 Kim ..... E05D 7/1044
10,260,261 B2 * 4/2019 Reuter ..... E05D 3/02
10,501,971 B2 * 12/2019 Zhang ..... E05D 5/10
10,588,428 B2 * 3/2020 Park ..... G02B 27/144
2006/0143860 A1 * 7/2006 Park ..... E05D 7/081 16/243
2007/0101543 A1 5/2007 Lu et al.
2009/0025178 A1 * 1/2009 Tamayama ..... E05D 5/065 16/221
2009/0179539 A1 * 7/2009 Henriksson ..... F25D 23/028 312/405
2011/0302743 A1 12/2011 Kim et al.
2013/0076222 A1 * 3/2013 Lee ..... F25D 23/028 312/405
2013/0154464 A1 * 6/2013 Fiori ..... E05D 7/0423 312/405
2015/0345203 A1 12/2015 Vanini
2016/0083993 A1 * 3/2016 Grewe ..... E05F 1/1223 16/291
2020/0173715 A1 * 6/2020 Kim ..... F21V 23/0471
2021/0095510 A1 * 4/2021 Lee ..... E05F 1/1215

* cited by examiner

PIVOT HINGE BRACKET ASSEMBLY

TECHNICAL FIELD

This invention relates generally to pivot hinges brackets, and more particularly to pivot hinge brackets used for commercial reach-in type refrigerator doors.

BACKGROUND OF INVENTION

Walk-in cold rooms, such as walk-in coolers, freezers, or other refrigerated environments such as reach-in refrigerators, are common in various industries, including convenience store, supermarkets and grocery stores, commercial kitchens, and other food service facilities. These cold rooms typically have a front door which is opened so that a person may reach into the refrigerated space and select an item.

These types of doors use a spring loaded pivot hinge which forces the door closed to aid in returning an open door to its fully closed position. These pivot hinges have a main housing or cartridge which fits within a channel within the door and a mounting bracket with a hole therethrough through which a mounting screw passes that is then threaded into the doorjamb. These types of doors also have a second bracket positioned on the same side of the door (left or right handed) and vertically opposite the hinge bracket. These second brackets include a pivot pin which extends into a mounting hole in the door or door frame. As such, the pivot hinge mounting bracket (first bracket) does not include a pivot pin while the second bracket includes a pivot pin, thus the two brackets are configured differently. To make matters worse, the configuration of left handed brackets used when the hinge is on the left side of the door are mirror images of the configuration of right handed brackets used when the hinge is on the right side of the door, thus creating another difference between brackets. These differences mean that an installer mounting the door in place utilizing these brackets must have four differently configured brackets on hand when the mounting position of the hinge is unknown until arriving at the job site, a right handed unpinned bracket, a left handed unpinned bracket, a right handed pinned bracket, and a left handed pinned bracket.

This problem is even more complicated with the bracket is supposed to include a door stop to prevent over pivoting of the door. On typical brackets, the door stop is simply a bent portion in the mounting flange that form a flanged stop to abut a portion of the door. Again, there is a difference between a right hand bracket having a door stop and a left hand bracket having a door stop. Because of this additional door stop feature, an installer may have to have six different brackets on hand, which in addition to the previous list of four bracket now includes a right handed stop bracket and a left handed stop bracket.

Accordingly, there is a need in the art for a pivot hinge bracket that will allow for different mounting positions on the door. It is to the provision of such therefore that the present invention is primarily directed.

SUMMARY OF THE INVENTION

In a preferred form of the invention a pivot hinge bracket assembly for use with a pivot hinge for a refrigerator door coupled to a doorjamb, comprises a first main bracket portion having a first edge mounting flange and a first rear mounting flange extending downwardly from the first edge mounting flange, the first edge mounting flange having at least one first pivot plate screw mounting hole and a first pivot pin mounting hole, the first rear mounting flange having at least one first door screw mounting hole. The pivot hinge bracket assembly also has a second main bracket portion having a second edge mounting flange and a second rear mounting flange extending upwardly from the second edge mounting flange, the second edge mounting flange having at least one second pivot plate screw mounting hole and a second pivot pin mounting hole, the second rear mounting flange having at least one second door screw mounting hole. The pivot hinge bracket assembly also has a pivot plate releaseably coupled to the first edge mounting flange of the first main bracket portion, the a pivot plate having a pivot plate mounting flange and an elongated pivot pin extending from the pivot plate mounting flange. The elongated pivot pin is positionable through the first pivot pin mounting hole of the first edge mounting flange. The pivot plate mounting flange has at least one pivot plate screw mounting hole therethrough alignable with the at least one first pivot plate screw mounting hole of the first edge mounting flange. A mounting screw passing through the at least one pivot plate screw mounting hole and into the at least one first pivot plate screw mounting hole to releaseably couple the pivot plate to the first main bracket portion.

DETAILED DESCRIPTION

With reference next to the drawings, there is shown a pivot hinge bracket assembly 5 according to the present invention. It is to be appreciated that the pivot hinge bracket assembly 5 is configured for use with a pivot hinge 10 for a reach-in type cool room, reach-in, refrigerator or freezer door D, referenced hereinafter collectively as a refrigerator.

Figure 4:
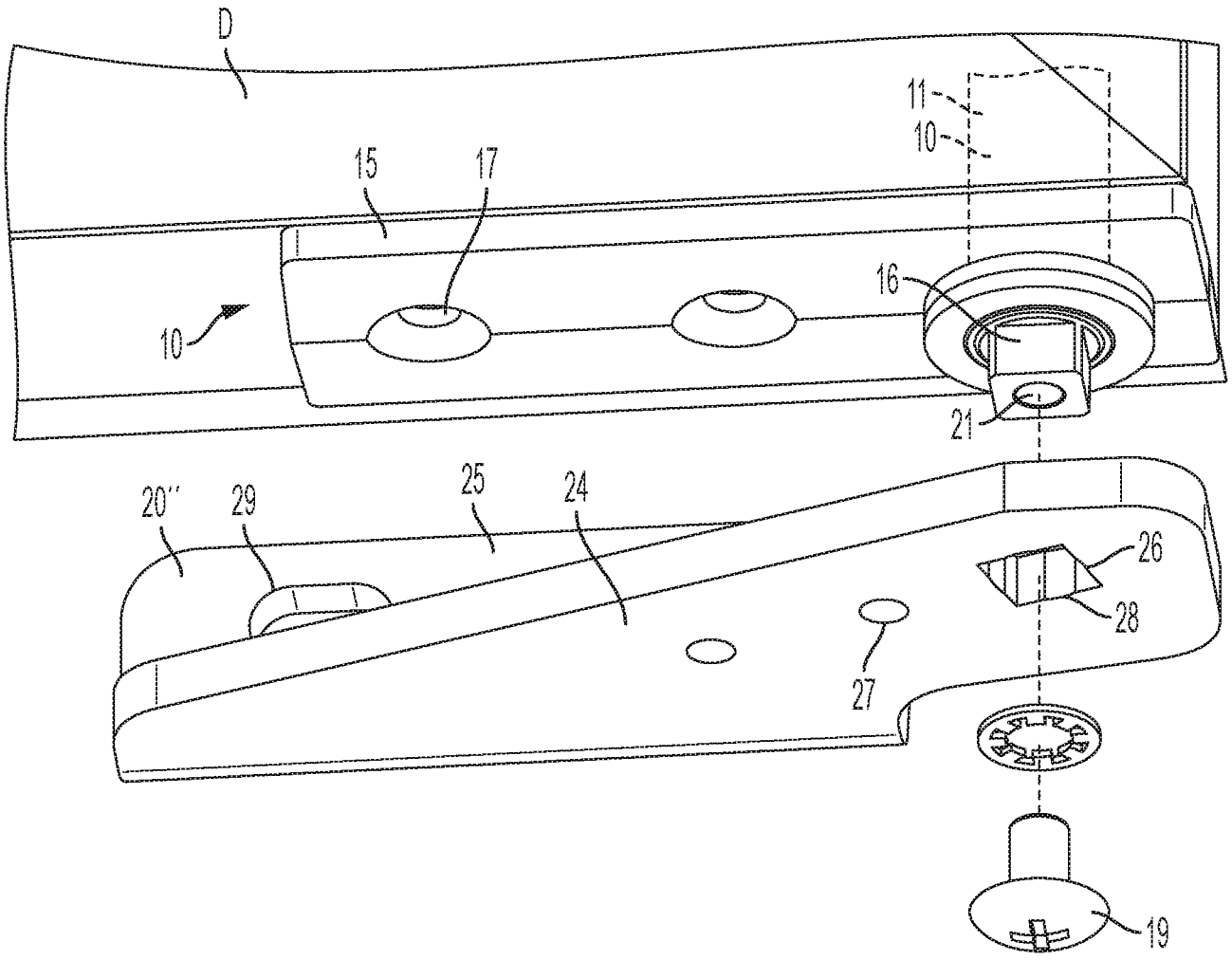
FIG. 4 is a perspective view of the lower main bracket portion of the pivot hinge bracket assembly of FIG. 1.

The pivot hinge 10 includes a metallic exterior spring housing 11, an unshown interior spring assembly positioned within the exterior housing 11, and a mounting plate, bracket or flange 15 fixedly mounted to the spring housing 11. The mounting plate 15 extends generally perpendicular to the spring housing 11. The mounting plate 15 has a bottom opening through which extends a square-shaped drive 16 coupled to the interior spring assembly, as best shown in FIG. 4. The mounting plate 15 includes two screw mounting holes 17 through which mounting screws 18 extend and are threadably mounted to the door jamb surrounding the door D. A securing screw 19 is threaded into a threaded hole 21 in the bottom of the square-shaped drive 16 to secure it to the pivot bracket assembly 5. As used herein, the term screws is intended to include bolts, threaded fasteners, fasteners, or the like.

The pivot hinge bracket assembly 5 has two mirror-imaged, metallic main bracket portions 20 and a removably coupled metallic pivot plate 22. The term "removably coupled", "removably mounted", "removably secured", "removably couple" or the like means that the pivot plate 22 is separate and apart from the main bracket portion 20 and that the two components are configured to be coupled to each other or coupled by a fastener which is easily removed and/or re-coupled to each other without force or damage to either component, such as mounting with a screw or bolt. Thus "removably coupled" does not include welding, pressing fitting, or the like as such is not easily removed from each other. Each main bracket portion 20 is generally L-shaped and includes a generally horizontal base or edge mounting flange 24 extending to a generally vertical door or rear mounting flange 25. The edge mounting flange 24 is configured to overlay the top or bottom edge of a door. The rear mounting flange 25 is configured to abut and be mounted against the rear surface of a door.

Figure 7:
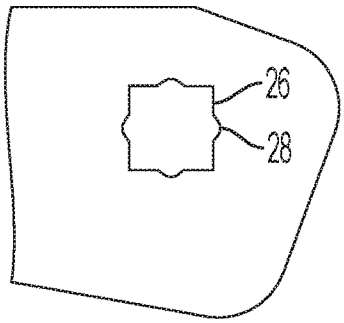
FIG. 7 is a top view of a portion of the main bracket portion of the pivot hinge bracket assembly of FIG. 1.

The edge mounting flange 24 has a modified square mounting hole 26 extending therethrough, and two internally threaded pivot pin plate screw mounting holes 27. As best shown in FIG. 7, the modified square mounting hole 26 has a generally square shape, but also has an arcuate indent 28 on each of the four sides of the square hole so that a round pin may fit snugly within the four indents 28 that in combination form a partial circular shape within the square shape, i.e., the modified square shape has hole side walls which define the square shape with an arcuate indent which in combination forms a partial circular shaped hole within a partial square shaped hole.

The rear mounting flange 25 has two elongated door screw mounting holes 29 therethrough. A mounting screw 30 passes through each door screw mounting hole 29 and is threaded into the door jamb surrounding the door D.

The pivot plate 22 includes a pivot plate mounting flange 32 and a vertically extending metallic pivot pin 33 that is press fitted, welded, threaded into, or otherwise secured to the pivot plate mounting flange 32. The pivot pin 33 has an enlarged first section 34 conforming to and residing within the circular portion of the modified square mounting hole 26 formed by indents 28, and a narrower round second section 35 extending from the first section 34. Two pivot plate mounting screws 36 pass through lock washers 37, through the two screw mounting holes 38 in the pivot plate mounting flange 32, and are threaded into the pivot pin plate screw mounting holes 27 of the edge mounting flange 24 to removably mount, couple or secure the pivot plate 22 to the main bracket portion 20.

Figure 5:
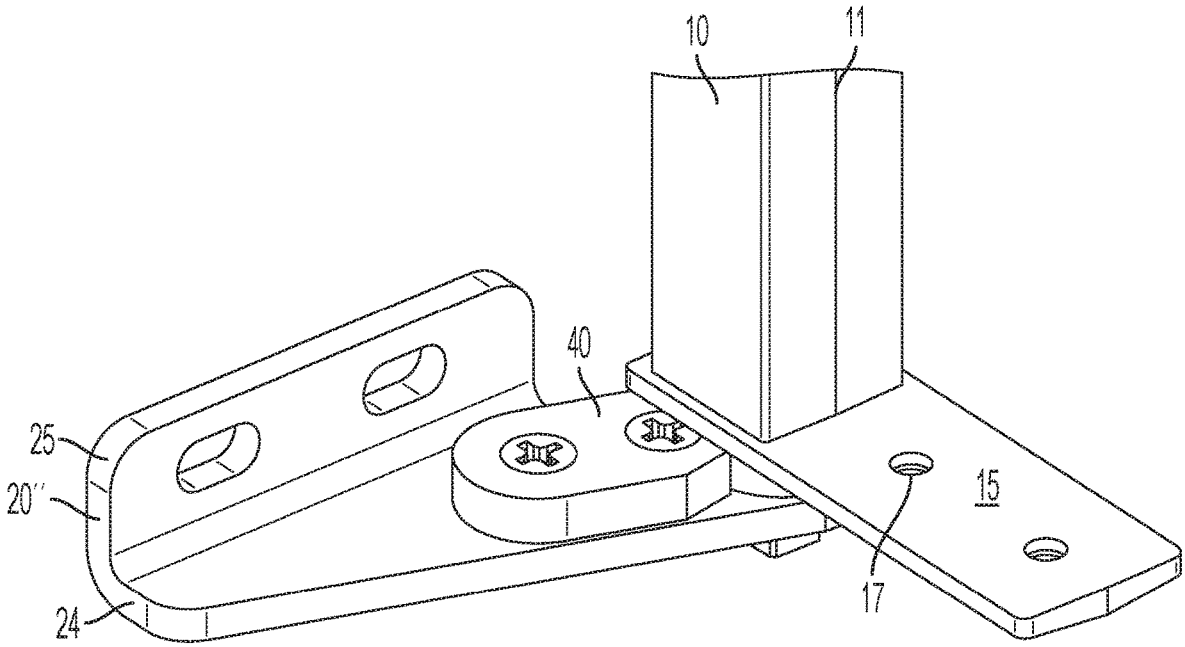
FIG. 5 is a perspective view of the lower main bracket portion of the pivot hinge bracket assembly of FIG. 1, shown with a door stop.
Figure 6:
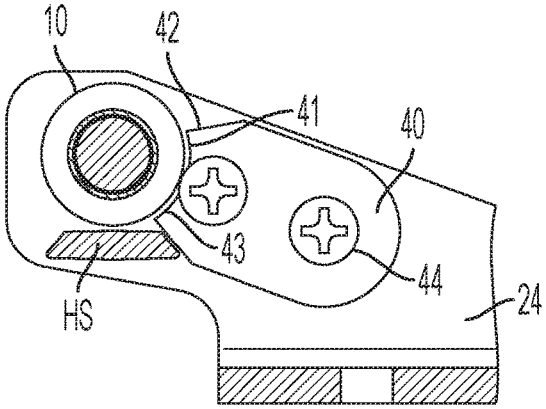
FIG. 6 is a top view of the lower main bracket portion of the pivot hinge bracket assembly of FIG. 1, shown with a door stop.

The pivot hinge bracket assembly 5 also includes an optional removably coupled door stop 40. The term "removably coupled" having the same meaning here as recited above. The door stop 40 has a curved or arcuate pivot front surface 41 configured to conform with a bottom portion of the pivot hinge for relative rotation therebetween, as best shown in FIGS. 5 and 6. The door stop 40 also includes two angled contact surfaces 42 extending from either side of the front surface 41. The door stop 40 also has a top surface 43 and two mounting holes 44 extending through the door stop 40 from the top surface 43. The two mounting holes 44 are alignable with the pivot pin plate screw mounting holes 27 of the edge mounting flange 24 so that mounting screws 36 may pass through the mounting holes 44 and be threaded into pivot pin plate screw mounting holes 27 to removably secure the door stop 40 to the edge mounting flange 24.

Figure 1:
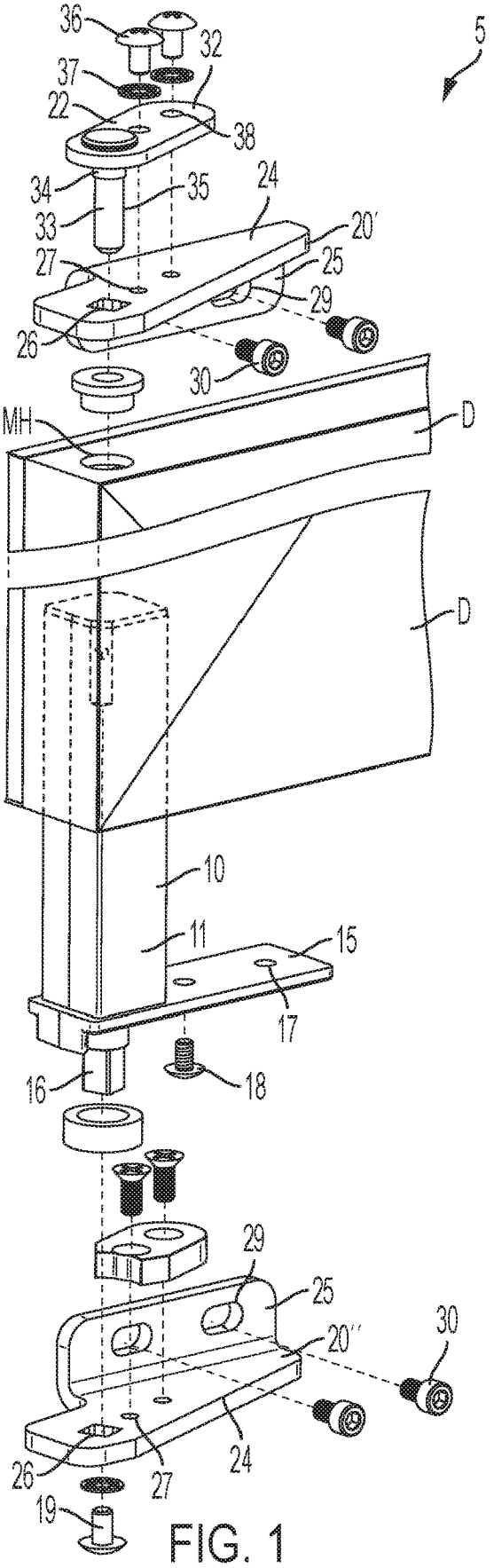
FIG. 1 is an exploded, perspective view of the pivot hinge bracket assembly embodying principles of the invention in a preferred form, including the door and pivot hinge.
Figure 2:
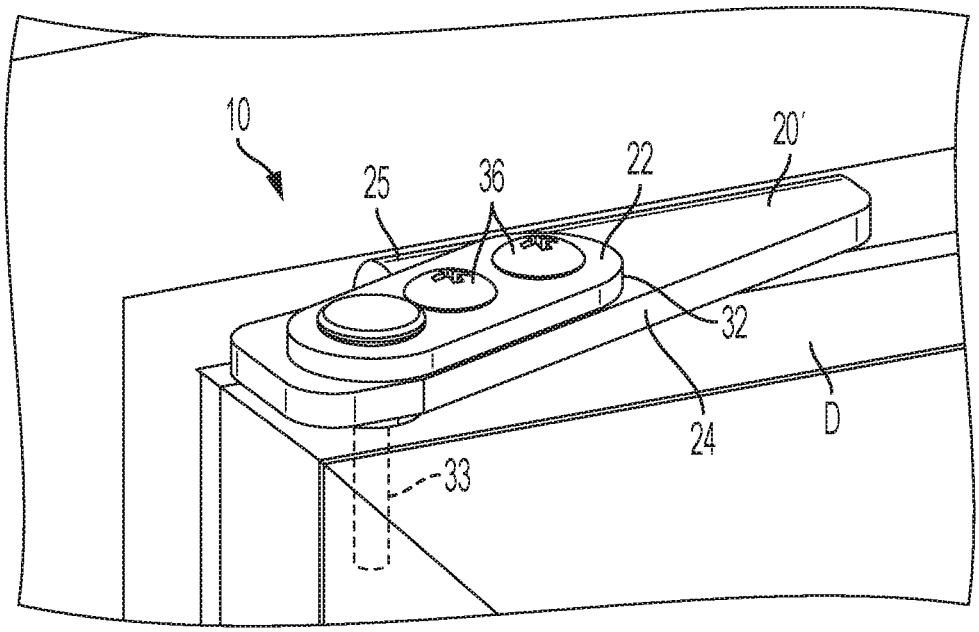
FIG. 2 is a perspective view of an upper main bracket portion of the pivot hinge bracket assembly of FIG. 1.
Figure 3:
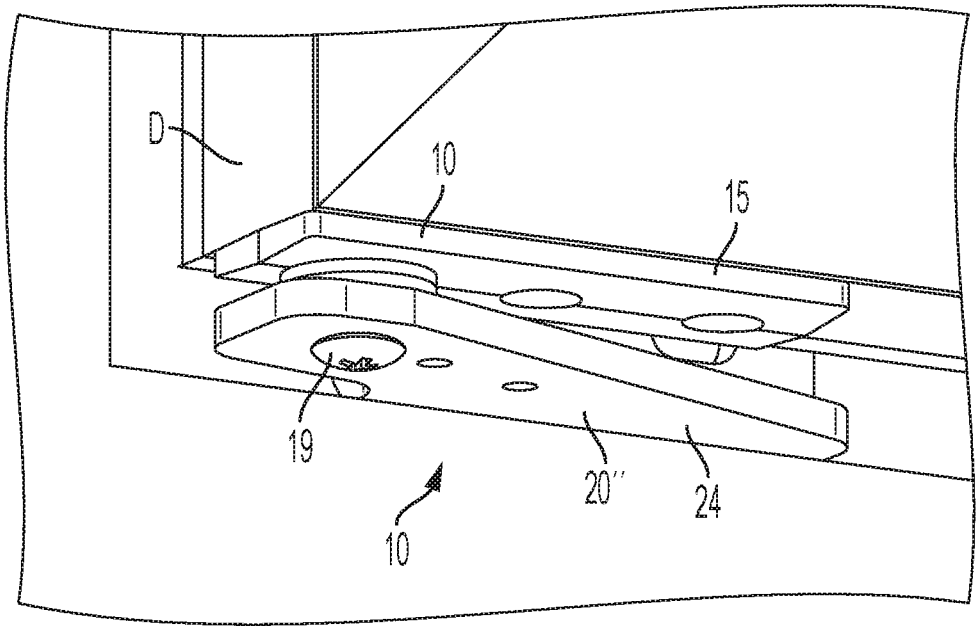
FIG. 3 is a perspective view of a lower main bracket portion of the pivot hinge bracket assembly of FIG. 1.

In use, in order to mount the door D with the pivot hinge bracket assembly 5, an installer need only a set of two main bracket portions 20 and one pivot plate 22, in addition to the door D and pivot hinge coupled to the door D. The two main bracket portions 20 are mirror images of each other, as shown in FIG. 1. With continued reference to FIG. 1, the main bracket portion 20' shown at the top of the figure has the edge mounting flange 24 oriented to be positioned above the top edge of the door D, and the rear mounting flange 25 extending downwardly from the rear side of the edge mounting flange 24 which is positioned against and coupled to the surrounding doorjamb. The main bracket portion 20" shown at the bottom of the figure has the edge mounting flange 24 oriented to be positioned below the bottom edge of the door D, and the rear mounting flange 25 extending upwardly from the rear side of the edge mounting flange 24 positioned against and coupled to the surrounding door jamb. Both main bracket portions 20' and 20" are mounted to the door D by passing mounting screws 30 through rear mounting flange door screw mounting holes 29 and threading the screws 30 into the door jamb surrounding the door D.

With the pivot hinge 10 already mounted to the bottom edge of the door D by passing mounting screws 18 through screw holes 17 in flange 15, the lower positioned main bracket portion 20" is coupled to the bottom of the door D with the square drive 16 of the pivot hinge 10 extending through the modified square hole 26 of the edge mounting flange 24. The main bracket portion 20" is fixed in place by passing mounting screws 30 through door screw mounting holes 29 and threading them into the door jamb surrounding the door D. The securing screw 19 is passed through the modified square hole 26 and is threaded into hole 21 in the drive 16 to secure th pivot hinge 10 to the lower positioned main bracket portion 20".

Should the optional door stop 40 be utilized for the select application, prior to the mounting of the main bracket portion 20" to the door D, the installer simply places the door stop 40 upon the top surface of the edge mounting flange 24 and secures it in place by passing mounting screws 36 through mounting holes 44 and threading them into underlying pivot pin plate screw mounting holes 27. The operation of the door D causes a hard stop HS portion of the door to abut the contact surface 42 of the door stop 40 to prevent any further rotation of the door D, as shown in FIG. 6.

The upper positioned main bracket portion 20' is mounted to the top edge of the door D with the pivot plate 22 removably secured to the main bracket portion 20' through mounting screws 36 passing through mounting holes 38 in the pivot plate mounting flange 32 and threading them into the underlying pivot pin plate mounting holes 27 in the edge mounting flange 24. The main bracket portion 20' is fixed in place by passing mounting screws 30 through door screw mounting holes 29 and threading them into the doorjamb surrounding the door D. The pivot pin 33 of the pivot plate 22 extends through the modified square hole 26 of the edge mounting flange 24 and into a pivot pin mounting hole MH in the top edge of the door D. The arcuate indents 28 in the modified square hole 26 conform to and snugly receive the round first section 34 of the pivot pin 33 to allow relative rotation therebetween.

With this configuration of the pivot hinge bracket assembly 5 with two mirror imaged main bracket portions 20' and 20", the main bracket portions 20 may be mounted as a left handed position shown in FIG. 1. Should a right handed position be required, the upper positioned and lower positioned main bracket portions are simply interchanged and the pivot plate 22 mounted to the oppositely disposed main bracket portion, i.e., the lower positioned main bracket portion 20 becomes the upper positioned main bracket portion 20, and the upper positioned main bracket portion 20 becomes the lower positioned main bracket portion 20. This swapping or interchanging of relative positions allows for only two main bracket portions 20 to be brought to the job site rather than having to have four brackets, the problem associated with hinge brackets of the prior art. This is accomplished by the ability to remove and relocate the pivot plate 22 upon either main bracket portion 20.

Furthermore, the ability to remove and relocate the door stop 40 again enables only two main bracket portions 20 to be necessary for any installation, regardless of whether the door has right or left handed hinges and right or left handed door stops. Hence, instead of having to have six different types of pivot hinge bracket assemblies on hand, as with the prior art, the installer need only have two mirror-imaged main bracket portions 20.

It should be understood that the modified square mounting hole 26 may receive either the square drive 16 of the pivot hinge 10 or the round pivot pin 33 of the pivot plate 22, however, for ease of explanation the square mounting hole may be referenced herein as pin mounting hole, even though it may be receiving the drive 16 rather than the pivot pin 33.

It should be understood that the position of the pivot hinge 10 may be on either the top edge or bottom edge of the door D, the figures shown the pivot hinge 10 mounted on the bottom edge. As such, the mounting of the pivot plate 22 and optional door stop 40 may be reversed relative to the door, with the pivot hinge 10 and optional door stop 40 being coupled to the upper main bracket portion 20 and the pivot plate 22 being mounted to the lower main bracket portion 20.

Thus, for purposes of the present disclosure, it is noted that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

While this invention has been described in detail with particular reference to the preferred embodiment thereof and the best mode of practicing same, it will be understood that variations and modifications can be effected within the spirit and scope of the invention as described herein above and as set forth in the appended claims.

The invention claimed is:

1. A pivot hinge bracket assembly for use with a pivot hinge for a refrigerator door coupled to a door jamb, the pivot hinge bracket assembly comprising, a first main bracket portion having a first edge mounting flange and a first rear mounting flange extending downwardly from said first edge mounting flange, said first edge mounting flange having at least one first pivot plate screw mounting hole and a first pivot pin mounting hole, said first rear mounting flange having at least one first door screw mounting hole;

a second main bracket portion having a second edge mounting flange and a second rear mounting flange extending upwardly from said second edge mounting flange, said second edge mounting flange having at least one second pivot plate screw mounting hole and a second pivot pin mounting hole, said second rear mounting flange having at least one second door screw mounting hole;

a pivot plate releaseably coupled to said first edge mounting flange of said first main bracket portion, said a pivot plate having a pivot plate mounting flange and an elongated pivot pin extending from said pivot plate mounting flange, said elongated pivot pin being positionable through said first pivot pin mounting hole of said first edge mounting flange, said pivot plate mounting flange having at least one pivot plate screw mounting hole therethrough alignable with said at least one first pivot plate screw mounting hole of said first edge mounting flange;

a mounting screw passing through said at least one pivot plate screw mounting hole and into said at least one first pivot plate screw mounting hole to releaseably couple said pivot plate to said first main bracket portion, and a door stop releaseably coupled to said second main bracket, said door stop has at least one door stop mounting hole alignable with said second pivot pin plate screw mounting hole of said second main bracket, and a door stop mounting screw extending through said door stop mounting hole and into said second pivot pin plate screw mounting hole of said second main bracket.

2. A pivot hinge bracket assembly for use with a pivot hinge for a refrigerator door coupled to a door jamb, the pivot hinge bracket assembly comprising, a first main bracket portion having a first edge mounting flange and a first rear mounting flange extending downwardly from said first edge mounting flange, said first edge mounting flange having at least one first pivot plate screw mounting hole and a first pivot pin mounting hole, said first rear mounting flange having at least one first door screw mounting hole;

a second main bracket portion having a second edge mounting flange and a second rear mounting flange extending upwardly from said second edge mounting flange, said second edge mounting flange having at least one second pivot plate screw mounting hole and a second pivot pin mounting hole, said second rear mounting flange having at least one second door screw mounting hole;

a pivot plate releaseably coupled to said first edge mounting flange of said first main bracket portion, said a pivot plate having a pivot plate mounting flange and an elongated pivot pin extending from said pivot plate mounting flange, said elongated pivot pin being positionable through said first pivot pin mounting hole of said first edge mounting flange, said pivot plate mounting flange having at least one pivot plate screw mounting hole therethrough alignable with said at least one first pivot plate screw mounting hole of said first edge mounting flange, and a mounting screw passing through said at least one pivot plate screw mounting hole and into said at least one first pivot plate screw mounting hole to releaseably couple said pivot plate to said first main bracket portion, wherein said first pivot pin mounting hole and said second pivot pin mounting hole have a modified square shape wherein each hole side wall defining the square shape has an arcuate indent which in combination forms a partial circular shaped hole within a partial square shaped hole.

3. A pivot hinge bracket assembly for use with a pivot hinge for a refrigerator door coupled to a door jamb, the pivot hinge bracket assembly comprising, a first main bracket portion having a first edge mounting flange and a first rear mounting flange extending from said first edge mounting flange, said first edge mounting flange having at least one first pivot plate screw mounting hole and a first pivot pin mounting hole, said first rear mounting flange having at least one first door screw mounting hole;

a second main bracket portion having a second edge mounting flange and a second rear mounting flange extending from said second edge mounting flange, said second edge mounting flange having at least one second pivot plate screw mounting hole and a second pivot pin mounting hole, said second rear mounting flange having at least one second door screw mounting hole;

said second main bracket portion being a mirror image of said first main bracket portion;

a pivot plate releaseably coupled to said first edge mounting flange of said first main bracket portion, said a pivot plate having a pivot plate mounting flange and an elongated pivot pin extending from said pivot plate mounting flange, said elongated pivot pin being positionable through said first pivot pin mounting hole of said first edge mounting flange;

a fastener releaseably coupling said pivot plate to said first main bracket portion, and a door stop releaseably coupled to said second main bracket, wherein said door stop has at least one door stop mounting hole alignable with a second pivot pin plate screw mounting hole in said second main bracket, and a door stop mounting screw extending through said door stop mounting hole and into said second pivot pin plate screw mounting hole of said second main bracket.

4. The pivot hinge bracket assembly of claim 3 wherein said pivot plate mounting flange has at least one pivot plate screw mounting hole therethrough alignable with said at least one first pivot plate screw mounting hole of said first edge mounting flange.

5. A pivot hinge bracket assembly for use with a pivot hinge for a refrigerator door coupled to a door jamb, the pivot hinge bracket assembly comprising, a first main bracket portion having a first edge mounting flange and a first rear mounting flange extending from said first edge mounting flange, said first edge mounting flange having at least one first pivot plate screw mounting hole and a first pivot pin mounting hole, said first rear mounting flange having at least one first door screw mounting hole;

a second main bracket portion having a second edge mounting flange and a second rear mounting flange extending from said second edge mounting flange, said second edge mounting flange having at least one second pivot plate screw mounting hole and a second pivot pin mounting hole, said second rear mounting flange having at least one second door screw mounting hole;

said second main bracket portion being a mirror image of said first main bracket portion;

a pivot plate releaseably coupled to said first edge mounting flange of said first main bracket portion, said a pivot plate having a pivot plate mounting flange and an elongated pivot pin extending from said pivot plate mounting flange, said elongated pivot pin being positionable through said first pivot pin mounting hole of said first edge mounting flange, a fastener releaseably coupling said pivot plate to said first main bracket portion, wherein said first pivot pin mounting hole and said second pivot pin mounting hole have a modified square shape wherein each hole side wall defining the square shape has an arcuate indent which in combination forms a partial circular shaped hole within a partial square shaped hole.

6. A pivot hinge bracket assembly for use with a pivot hinge with a square-shaped drive for a refrigerator door coupled to a door jamb, the pivot hinge bracket assembly comprising, a first main bracket portion having a first base flange and a first door mounting flange extending downwardly from said first base flange, said first base flange having at least one first pivot plate screw mounting hole and a first pivot pin mounting hole, said first door mounting flange having at least one first door screw mounting hole;

a second main bracket portion having a second base flange and a second door mounting flange extending upwardly from said second base flange, said second base flange having at least one second pivot plate screw mounting hole and a second pivot pin mounting hole, said second door mounting flange having at least one second door screw mounting hole;

a pivot plate releaseably coupled to said first base flange of said first main bracket portion, said a pivot plate having a pivot plate mounting flange and an elongated pivot pin extending from said pivot plate mounting flange, said elongated pivot pin being positionable through said first pivot pin mounting hole of said first base flange, said pivot plate mounting flange having at least one pivot plate screw mounting hole therethrough alignable with said at least one first pivot plate screw mounting hole of said first base flange;

said first pivot pin mounting hole and said second pivot pin mounting hole being configured to snugly receive the square-shaped drive of the pivot hinge and configured to snugly receive said circular-shaped pivot pin;

a threaded fastener passing through said at least one pivot plate screw mounting hole and into said at least one first pivot plate screw mounting hole to releaseably couple said pivot plate to said first main bracket portion, and a door stop releaseably coupled to said second main bracket, wherein said door stop has at least one door stop mounting hole alignable with said second pivot pin plate screw mounting hole of said second main bracket, and a door stop mounting screw extending through said door stop mounting hole and into said second pivot pin plate screw mounting hole of said second main bracket.

7. A pivot hinge bracket assembly for use with a pivot hinge with a square-shaped drive for a refrigerator door coupled to a door jamb, the pivot hinge bracket assembly comprising, a first main bracket portion having a first base flange and a first door mounting flange extending downwardly from said first base flange, said first base flange having at least one first pivot plate screw mounting hole and a first pivot pin mounting hole, said first door mounting flange having at least one first door screw mounting hole;

a second main bracket portion having a second base flange and a second door mounting flange extending upwardly from said second base flange, said second base flange having at least one second pivot plate screw mounting hole and a second pivot pin mounting hole, said second door mounting flange having at least one second door screw mounting hole;

a pivot plate releaseably coupled to said first base flange of said first main bracket portion, said a pivot plate having a pivot plate mounting flange and an elongated pivot pin extending from said pivot plate mounting flange, said elongated pivot pin being positionable through said first pivot pin mounting hole of said first base flange, said pivot plate mounting flange having at least one pivot plate screw mounting hole therethrough alignable with said at least one first pivot plate screw mounting hole of said first base flange;

said first pivot pin mounting hole and said second pivot pin mounting hole being configured to snugly receive the square-shaped drive of the pivot hinge and configured to snugly receive said circular-shaped pivot pin, and a threaded fastener passing through said at least one pivot plate screw mounting hole and into said at least one first pivot plate screw mounting hole to releaseably couple said pivot plate to said first main bracket portion, wherein said first pivot pin mounting hole and said second pivot pin mounting hole have a modified square shape wherein each hole side wall defining the square shape has an arcuate indent which in combination forms a partially circular shaped hole within a partially square shaped hole.

* * * * *